US009903034B2

(12) United States Patent
Chen et al.

(10) Patent No.: US 9,903,034 B2
(45) Date of Patent: Feb. 27, 2018

(54) METHODS AND MATERIALS FOR ELECTROPLATING ALUMINUM IN IONIC LIQUIDS

(71) Applicant: Sikorsky Aircraft Corporation, Stratford, CT (US)

(72) Inventors: Lei Chen, South Windsor, CT (US); Xiaomei Yu, Westport, CT (US); William P. Fallon, Wallingford, CT (US)

(73) Assignee: SIKORSKY AIRCRAFT CORPORATION, Stratford, CT (US)

( * ) Notice: Subject to any disclaimer, the term of this patent is extended or adjusted under 35 U.S.C. 154(b) by 737 days.

(21) Appl. No.: 14/087,876

(22) Filed: Nov. 22, 2013

(65) Prior Publication Data

US 2015/0144495 A1 May 28, 2015

(51) Int. Cl.

| | |
|---|---|
| ***C25D 3/44*** | (2006.01) |
| ***C25D 3/66*** | (2006.01) |
| ***C25D 21/18*** | (2006.01) |
| ***C25D 5/00*** | (2006.01) |

(52) U.S. Cl.

CPC ..... *C25D 5/006* (2013.01); *C25D 3/665* (2013.01); *C25D 5/003* (2013.01); *C25D 21/18* (2013.01); *C25D 3/44* (2013.01)

(58) Field of Classification Search

CPC ..... C25D 3/665; C25D 3/44

See application file for complete search history.

(56) References Cited

U.S. PATENT DOCUMENTS

| | | | | |
|---|---|---|---|---|
| 2,170,375 | A * | 8/1939 | Mathers | C25D 3/44 205/237 |
| 2,446,349 | A * | 8/1948 | Wier, Jr. | C25D 3/44 205/237 |
| 2,902,416 | A * | 9/1959 | Doumas | C25D 3/44 205/237 |
| 2002/0060161 | A1* | 5/2002 | Roe | C25B 1/003 205/340 |
| 2007/0237957 | A1* | 10/2007 | Yamashiro | C23C 2/04 428/403 |
| 2012/0006688 | A1 | 1/2012 | Alemany et al. | |
| 2012/0156519 | A1* | 6/2012 | Piascik | C25D 3/44 428/650 |

(Continued)

FOREIGN PATENT DOCUMENTS

WO WO2007035457 A2 3/2007

OTHER PUBLICATIONS

Lv et al., Polyoxometalate water oxidation catalysts and the production of green fuel, 41 Chem. Soc. Rev. 7572 (2012).*

(Continued)

*Primary Examiner* — Bryan D. Ripa
*Assistant Examiner* — Ho-Sung Chung
(74) *Attorney, Agent, or Firm* — Cantor Colburn LLP

(57) ABSTRACT

A method of depositing aluminum onto a substrate is disclosed. In this method, the substrate is disposed as cathode in an electrochemical cell with an anode and a liquid electrodeposition composition comprising an ionic liquid and a source of aluminum, and aluminum is electroplated onto the substrate. Residual water content in the electroplating bath is controlled by exposure to light in the presence of a photo-oxidation catalyst to decompose the water or species associated with water.

16 Claims, 1 Drawing Sheet

(56) References Cited

U.S. PATENT DOCUMENTS

| | | | | |
|---|---|---|---|---|
| 2012/0189778 | A1 | 7/2012 | Riewe et al. | |
| 2012/0205249 | A1* | 8/2012 | Inoue | C25D 3/44 205/143 |
| 2013/0075271 | A1 | 3/2013 | Yu et al. | |
| 2013/0168258 | A1 | 7/2013 | Nakano et al. | |

OTHER PUBLICATIONS

Song et al., K7[ColllColl(H2O)W11O39]: a molecular mixed-valence Keggin polyoxometalate catalyst of high stability and efficiency for visible light-driven water oxidation, 6 Energy Environ. Sci. 1170 (2013).*

Bernardini, Gianluca, Wedd, Anthony G., Zhao, Chuan, and Bond, Alan M., "Photochemical oxidation of water and reduction of polyoxometalate anions at interfaces of water with ionic liquids or diethylether", pp. 11552-11557, Jul. 17, 2012, PNAS, vol. 109, No. 29.

* cited by examiner

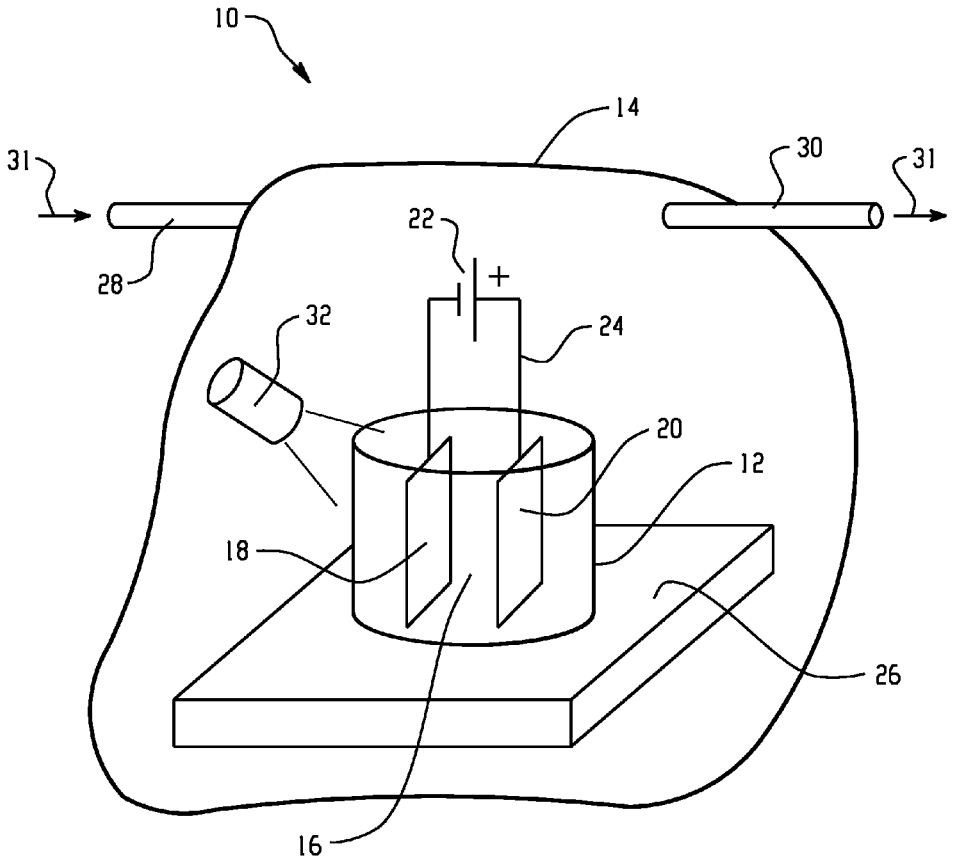
10
14
31
30
31
22
+
28
32
24
20
12
18
26
16

METHODS AND MATERIALS FOR ELECTROPLATING ALUMINUM IN IONIC LIQUIDS

BACKGROUND OF THE INVENTION

The subject matter disclosed herein generally relates to aluminum electroplating process control.

Aluminum (Al) offers a number of beneficial properties that make it useful for a variety of applications, including as a coating for corrosion protection or other purposes. Unlike some other metal coatings, aluminum coatings cannot be deposited using an aqueous electrolyte electroplating process, as the electrochemical conditions that would be necessary to cause the deposition of aluminum also cause water to decompose, forming hydrogen and oxygen before the metals can be deposited. An electroplating process for aluminum was developed by Ziegler and Lehmkuhl in the 1950's, and was later commercially developed and came to be known as the Sigal process. This process utilizes a highly air- and water-sensitive mixture of organoaluminum (triethlyaluminium) compounds, aromatic solvents, and other additives such as alkali halides or hydrides and quaternary onium salts. The pyrophoric triethlyaluminium compound can spontaneously decompose in air by reaction with atmospheric oxygen and moisture, resulting in flame formation and the concomitant handling and safety issues. Ion vapor deposition (IVD) can also be used to deposit aluminum layers; however, as a physical vapor deposition process it is subject to limitations in deposition rate, which can lead to limitations on layer thickness, or excessive cost and difficulty of use. Electroplating Al from ionic liquids (IL's), on the other hand, is considered an environmentally friendly alternative. Historically, the Lewis acidic 1-ethyl-3-methylimidazolium chloride [EMIM][Cl]—$AlCl_3$ systems have been favored since the genesis of Al plating in ILs attributed to Osteryoung, Wilkes and Hussey two decades ago. This process has the potential to offer the benefits of an electroplating process without the handling and safety issues of the Sigal process. This process is, however, highly susceptible to moisture in the operating environment, and even water levels as low as 0.1% wt. of the electrolyte have been shown to produce undesirable aluminum oxychloride side products according to the reaction:

$$Al_2Cl_7^- + H_2O \rightarrow AlOCl + 2HCl + AlCl_4^-$$

Such a low threshold for water content can be difficult to maintain, even when starting materials are dry, as the mere act of accessing the electroplating bath to insert or remove workpiece substrates can result in the accumulation of undesirable levels of moisture in the system. During electroplating, water can enter the IL electroplating bath via vapor/liquid phase boundaries or liquid/liquid phase boundaries if a second liquid phase is disposed on top of the plating solution as a barrier layer. Although numerous water stable and hydrophobic ionic liquids have been discovered and made commercially available, water absorption appears to be inevitable. For instance, a substantial amount of water (ca. 2000 ppm or 0.2% wt.) can be present even for the ILs known to be most hydrophobic, i.e. 1-hexyl-3-methylimidazolium tris(pentafluoroethyl) trifluorophosphate (HEMFAP). Thus, minimizing the amount of water in the electroplating bath and operating environment seems to be necessary to commercialize aluminum plating in ILs.

Each of the above-described and other aluminum coating techniques have their own unique set of advantages and disadvantages, such that new and different alternatives are always well received that might be more appropriate for or function better in certain environments or are less costly or more effective.

BRIEF DESCRIPTION OF THE INVENTION

According to one aspect of the invention, a method of depositing aluminum onto a substrate is provided. In this method, the substrate is disposed as cathode in an electrochemical cell with an anode and a liquid electrodeposition composition comprising an ionic liquid and a source of aluminum, and aluminum is electroplated onto the substrate. Residual water content in the electroplating bath is controlled by exposure to light in the presence of a photo-oxidation catalyst to decompose the water or species associated with water.

According to another aspect of the invention, an aluminum electrodeposition composition comprises an ionic liquid, an aluminum salt, and a photo-oxidation catalyst capable of promoting the decomposition of water.

According to yet another aspect of the invention, an electrochemical cell for the electroplating of aluminum comprises a substrate as cathode for receiving the electroplating of aluminum and an anode. A liquid electroplating bath comprises an ionic liquid and a source of aluminum. A photo-oxidation catalyst capable of promoting the photo-oxidation of water is in contact with the electroplating bath, and a light source is also present to provide irradiation to photo-oxidize residual water that is present in the electroplating bath.

According to yet another aspect of the invention, an IL electroplating bath comprises the IL phase containing aluminum salt for electrodeposition and an immiscible phase that forms a barrier to protect the electroplating phase from contamination. A photo-oxidation catalyst capable of promoting the oxidation of water is dissolved or dispersed in the barrier phase and a light source is also present to provide irradiation to decompose water either in the bulk of the barrier phase or at the vapor-liquid phase boundary or liquid-liquid phase boundary.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawing in which:

The FIGURE depicts a schematic diagram of an exemplary electrochemical cell.

DETAILED DESCRIPTION OF THE INVENTION

As mentioned above, the electrolyte for electroplating described in the embodiments disclosed herein comprises an ionic liquid. Ionic liquids are generally recognized in the scientific literature as being salts having a melting point below 100° C.;

Ionic liquids are well-known, and have been the subject of significant study and research. Ionic liquids tend to be air and water stable. Exemplary cations for ionic liquids used in the embodiments described herein include, but are not limited to imidazolium (e.g., 1-ethyl-3-methylimidazolium, 1-ethyl-2,3-dimethylimidazolium, 1-butyl-3-methylimidazolium ("BMI"), 1-hexyl-3-methyl-imidazolium ("HMI"), pyridinium (e.g., N-methylpyridinium), tetraalkylammonium, pyrrolidinium (e.g., 1-butyl-1-methyl-pyrrolidinium ("BMPyr"), trialkylsulfonium (e.g., triethylsulfonium), pyrazolium, triazolium, thiazolium, oxazolium, pyridazinium, pyrimidinium, pyrazinium. Exemplary anions for ionic liquids used in the embodiments described herein include, but are not limited to, chloroaluminate ($Al_2Cl_7^-$), tetrafluoroborate ($BF_4$), hexafluorophosphate ($PF_6$), trifluoromethanesulfonate ($CF_3SO_3$), bis(trifluoromethylsulfonyl) imide, trifluoroethanoate, nitrate, SCN, $HSO_4$, $HCO_3$, $CH_3SO_3$, $CH_3CH_2SO_4$, $(CH_3(CH_2)_3O)_2POO$, $(CF_3SO_2)_2N$, dicyanamide, $(CF_3CF_2SO_2)_2N$, L-(+)-lactate, $CH_3SO_4$, and $CH_3COO$, and the like.

In some exemplary embodiments, the ionic liquid has a cation that is an imidazolium, and more specifically the ionic liquid has the formula:

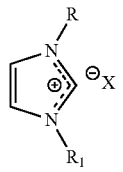

wherein, R and $R_1$ are independently selected from H, an unsubstituted or substituted alkyl group having 1 to 30 carbon atoms, or an unsubstituted or substituted aryl group having 6 to 30 carbon atoms. $X^{\Theta}$ is an anionic group, as described hereinabove, that associates with imidazolium to form an ionic-liquid cation/anion pair.

In addition to the cation (or mixtures of cations) and anion (or mixtures of anions) of the ionic liquid, the liquid electrodeposition composition also comprises an aluminum salt. Aluminum salt can be introduced to the composition in the form of aluminum chloride ($AlCl_3$), but will tend to form different aluminum-containing ions in the ionic liquid composition, including but not limited to $AlCl_4^-$ (tetrachloroaluminate) and, $Al_2Cl_7^-$ (heptachlorodialuminate). Aluminum-containing anions can also be introduced electrolytically by electrochemical reaction of metallic aluminum in the anode(s) of an electrochemical cell of which the electrodeposition forms a part.

The electrodeposition composition can also include additives to improve the integrity of the aluminum coating such as a nucleation aid like a surfactant. Other additives are known in the art, see, e.g., US 2012/0006688 A1, the disclosure of which is incorporated herein by reference, and can be included as well. Organic solvents can also be present in amounts up to 30 wt. %, such as toluene, chlorobenzene, dichlorobenzenes, xylene, cyclohexane, heptane, and others.

As described herein, residual water in the liquid composition is reduced, eliminated, or otherwise controlled by exposure to light in the presence of photooxidization catalyst to photooxidize the water. By "residual" water, this disclosure is referring to water that was not removed by other more conventional drying processes or that was unintentionally introduced into the system. Residual levels are considered to be below 1 wt. %, more specifically below 0.5 wt. %, even more specifically below 0.1 wt. %, and even more specifically below 0.05 wt. %. In some embodiments, the photooxidation is used to reduce the water content from a level greater than 0.1 wt. % to a level of less than 0.1 wt. %, more specifically less than 0.08 wt. % and more specifically less than 0.05 wt. %.

Photocatalytic water splitting proceeds by the total reaction $$2H_2O+h\nu \rightarrow 2H_2+O_2$$

either on the same photocatalyst or on two separate photocatalytic electrodes. The photocatalytic water splitting has been explored as a method of producing hydrogen for energy production. The reaction typically requires a catalyst or promoter, which are also known in the art. Specifically, heterogeneous semiconductor catalysts such as $TiO_2$ are used in such applications. The photocatalytic water splitting results in both hydrogen and oxygen evolution and generally has very low efficiency. Using heterogeneous photocatalysts in relatively more viscous ionic liquids and low water concentration media has not been shown to be successful. Biological-based systems are known to rely on protein complexes located in the thylakoid membranes of plants, algae, and cyanobacteria to promote photo-oxidation of water according to the reaction $$2PQ+2H_2O\ h\nu \rightarrow O_2+2PQH_2$$

where PQ is a plastiquinone acceptor. Other known photooxidation catalysts include ruthenium and/or iridium complexes such as the "ruthenium blue dimer", $[cis,cis\text{-}Rbpy)_2(H_2O)Ru^{III}ORu^{III}(OH_2)(bpy)_2]^{4-}$ (where "bpy" stands for bipyridine) and ruthenium and iridium complexes containing polyxometalate anions as ligands. 7,7,8,8-tetracyanoquinodimethane (TCNQ). Up to date, very limited homogeneous catalysts, i.e. residing in the same phase as the liquid medium, can be used for water decomposition.

Polyoxometalate salts (e.g., polyoxometalate anions with an appropriate cation such as potassium) are also well-known as photocatalysts. In some embodiments, polyoxometalate anions α-Keggin structure, which has general formula of $[XM_{12}O_{40}]^{n-}$, where X is the heteroatom (most commonly are $P^{5+}$, $Si^{4+}$, or $B^{3+}$), M is the addenda atom (most common are molybdenum and tungsten), and O represents oxygen. The stoichiometry of the polyoxometalate can vary. Polyoxometalate anions include mostly polyoxotungstates (e.g., $[P_2W_{18}O_{62}]^{6-}$, and polyoxomolybdates. Polyoxometalate compounds are soluble in many ionic liquids and exhibit interesting photocatalytic activity towards water oxidation, particularly at phase boundaries where the water activity differs greatly across the phases. Compared with the heterogeneous photocatalytic water splitting reactions, the water oxidation reaction enabled by polyoxometalate anions causes only oxygen evolution, hence it is likely to be more efficient for the particular practice disclosed in this invention, where protons produced by the partial splitting of residual water in the ionic liquids. In particular, the excess protons would react with chloride or other anions, which can be replenished by adding more aluminum chloride to the ionic liquid solution as a general practice to maintain the bath composition.

Referring now to the FIGURE, an exemplary system 10 with an electrochemical cell is schematically depicted. In the FIGURE, electrodeposition vessel 12 is disposed inside enclosure 14. An electroplating bath of liquid electrodeposition composition 16 comprising an ionic liquid and an aluminum salt is disposed in the vessel 12. A layer (not shown) of a liquid immiscible with the ionic liquid can be disposed on the surface of the liquid electrodeposition composition 16, as a barrier layer between the electrodeposition composition 16 and the gas space adjacent to it. Liquids used for such barrier layers include, for example, hydrocarbons such as hexane, or an ionic liquid that is immiscible with the ionic liquid in the electrodeposition composition 16. Examples of immiscible ionic liquids include phosphonium cations (e.g., $P_{66614}$), which can be paired with a hydrophobic anion such as bis{(trifluoromethyl)sulfonyl}amide. The substrate to be coated is disposed in the electroplating bath as cathode 18 along with anode 20. The cathode 18 and anode 20 are electrically connected to power source 22 through circuit 24. The vessel 12 is optionally provided with heat to provide proper conditions for the electrodeposition of aluminum, and is shown in the FIGURE disposed on heated plate 26. The enclosure 14 may optionally be equipped with gas inlet 28 and gas outlet 30 for flowing a dry purge gas 31 such as air/nitrogen to remove unwanted byproducts such as HCl, water vapor and oxygen from the enclosure.

In practice, an electrical current is provided by power source 22 that is sufficient to provide an electric current density (current per effective electrode area) of at least 50 $A/m^2$, more specifically of at least 100 $A/m^2$, even more specifically at least 200 A/m2, and even more specifically at least 800 $A/m^2$. Current is applied until the desired aluminum coating layer thickness is achieved (e.g., 5 to 50 μm). The electrodeposition method can be carried out at temperatures ranging from 20° C. to 200° C., more specifically from 20° C. to 120° C., and even more specifically from 60° C. to 100° C., and even more specifically from 85° C. to 95° C.

In the embodiment shown in the FIGURE, light source 32 is placed inside the enclosure 14 for the photo-irradiation. The photo-oxidation catalyst can be dispersed or dissolved in the electrodeposition composition such that light exposure from the light source 32 exposes the photo-oxidation catalyst to light in the presence of the electrodeposition composition. In other embodiments (not shown), the light source 32 could disposed in the liquid electrodeposition composition or could be located in a separate tank remote from the electroplating vessel 12, with the electrodeposition composition 16 circulating from the tank to the remote tank. In still other embodiments, the photo-oxidation catalyst can be immobilized on a support that is proximate to the light source, and the electrodeposition composition can be caused to flow past the immobilized photo-oxidation catalyst bed. Light exposure can occur continuously throughout the electrodeposition process, or for limited duration exposures periodically during the electrodeposition process, or in a regeneration cycle when electrodeposition is not occurring.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of depositing aluminum onto a substrate, comprising disposing a substrate as cathode and an anode in an electroplating bath that includes an ionic liquid, a source of aluminum, and greater than 0.1 wt. % but less than 1 wt. % of water;

electroplating aluminum onto the substrate in the electroplating bath; and exposing the electroplating bath to light in the presence of a photo-oxidation catalyst to decompose water.

2. The method of claim 1, wherein the photo-oxidation catalyst is dissolved in the ionic liquid.

3. The method of claim 1, wherein the electroplating bath comprises a first phase comprising the ionic liquid and the source of aluminum, and a second barrier phase between the ionic liquid phase and a gas space.

4. The method of claim 3, wherein the photo-oxidation catalyst is in the barrier phase.

5. The method of claim 1, wherein the photo-oxidation catalyst is immobilized on a catalyst support in contact with the ionic liquid.

6. The method of claim 1, wherein the photo-oxidation catalyst is a polyoxometalate, a biochemical photo-oxidation catalyst, metal polypyridyl photocatalysts (ruthenium bipyridine $Ru(bpy)_3^{2+}/Ru(bpy)_3^{3+}$), ruthenium blue dimer, or 7,7,8,8-tetracyanoquinodimethane.

7. The method of claim 6, wherein the photo-oxidation catalyst is a polyoxometalate.

8. The method of claim 7, wherein the polyoxometalate is a polyoxomolybdate or a Keggin structure polyoxotungstate.

9. The method of claim 7, wherein the polyoxometalate is a Keggin structure polyoxotungstate.

10. The method of claim 7, wherein the polyoxometalate is $[P_2W_{18}O_{62}]^{6-}$.

11. The method of claim 1, further comprising contacting the electroplating bath with a purge gas to remove HCl and oxygen byproducts.

12. The method of claim 10, wherein the cathode substrate includes steels, aluminum alloys, nickel and/or nickel superalloys.

13. The method of claim 1, wherein the ionic liquid has cations and anions, the cations comprising imidazolium, pyridinium, tetraalkylammonium, pyrrolidinium, trialkylsulfonium, pyrazolium, thiazolium, oxazolium, pyridazinium, pyrimidinium, pyrazinium, or a combination comprising at least one of the foregoing; and the anions comprising chloroaluminate, tetrafluoroborate, hexafluorophosphate, trifluoromethanesulfonate, bis(trifluoromethylsulfonyl)imide, trifluoroethanoate, nitrate, SCN, $HSO_4$, $HCO_3$, $CH_3SO_3$, $CH_3CH_2SO_4$, $(CH_3(CH_2)_{30})_2POO$, $(CF_3SO_2)_2N$, dicyanamide, $(CF_3CF_2SO_2)_2N$, L-(+)-lactate, $CH_3SO_4$, $CH_3COO$, or a combination comprising at least one of the foregoing; and the photo-oxidation catalyst is a polyoxometalate, a biochemical photo-oxidation catalyst, metal polypyridyl photocatalysts (ruthenium bipyridine $Ru(bpy)_3^{2+}/Ru(bpy)_3^{3+}$), ruthenium blue dimer, or 7,7,8,8-tetracyanoquinodimethane.

14. The method of claim 1, wherein exposing the electroplating bath to light in the presence of a photo-oxidation catalyst occurs continuously during the electroplating.

15. The method of claim 1, wherein exposing the electroplating bath to light in the presence of a photo-oxidation catalyst occurs periodically during the electroplating.

16. A method of depositing aluminum onto a substrate, comprising disposing an anode and a substrate as cathode in an electroplating bath that includes an ionic liquid, a source of aluminum, and less than 1 wt. % of water;

electroplating aluminum onto the substrate in the electroplating bath; and exposing the electroplating bath to light in the presence of a photo-oxidation catalyst to decompose water when or after electroplating commences.

* * * * *